United States Patent [19]

Mazzola

[11] 4,403,407

[45] Sep. 13, 1983

[54] MULTIPLE WIRE TERMINAL APPLYING

[75] Inventor: Ralph Mazzola, Brighton, Mass.

[73] Assignee: Ark-les Corporation, Watertown, Mass.

[21] Appl. No.: 270,616

[22] Filed: Jun. 1, 1981

[51] Int. Cl.[3] ..... H01R 43/04

[52] U.S. Cl. ..... 29/749; 29/564.1; 29/564.6; 29/753; 29/759; 29/863; 29/866

[58] Field of Search ..... 29/753, 751, 799, 759, 29/863–867, 564.4, 564.6, 564.1

[56] References Cited

U.S. PATENT DOCUMENTS

| | | | |
|---|---|---|---|
| 3,239,924 | 3/1966 | Wagner | 29/753 X |
| 3,672,025 | 6/1972 | Gudmestad | 29/753 X |
| 3,742,564 | 7/1973 | Dyksterhouse | 29/564.6 X |
| 4,164,808 | 8/1979 | Gudmestad et al. | 29/753 X |
| 4,171,566 | 10/1979 | Tominol | 29/742 X |

*Primary Examiner*—Carl E. Hall

[57] ABSTRACT

A novel automatic multiple wire terminal applying machine which is selectively operable to simultaneously attach to one or both of the adjacent or opposite ends of multiple lengths of wire either a single terminal common to all of the wires or an individual terminal on each wire.

8 Claims, 15 Drawing Figures

FIG 1
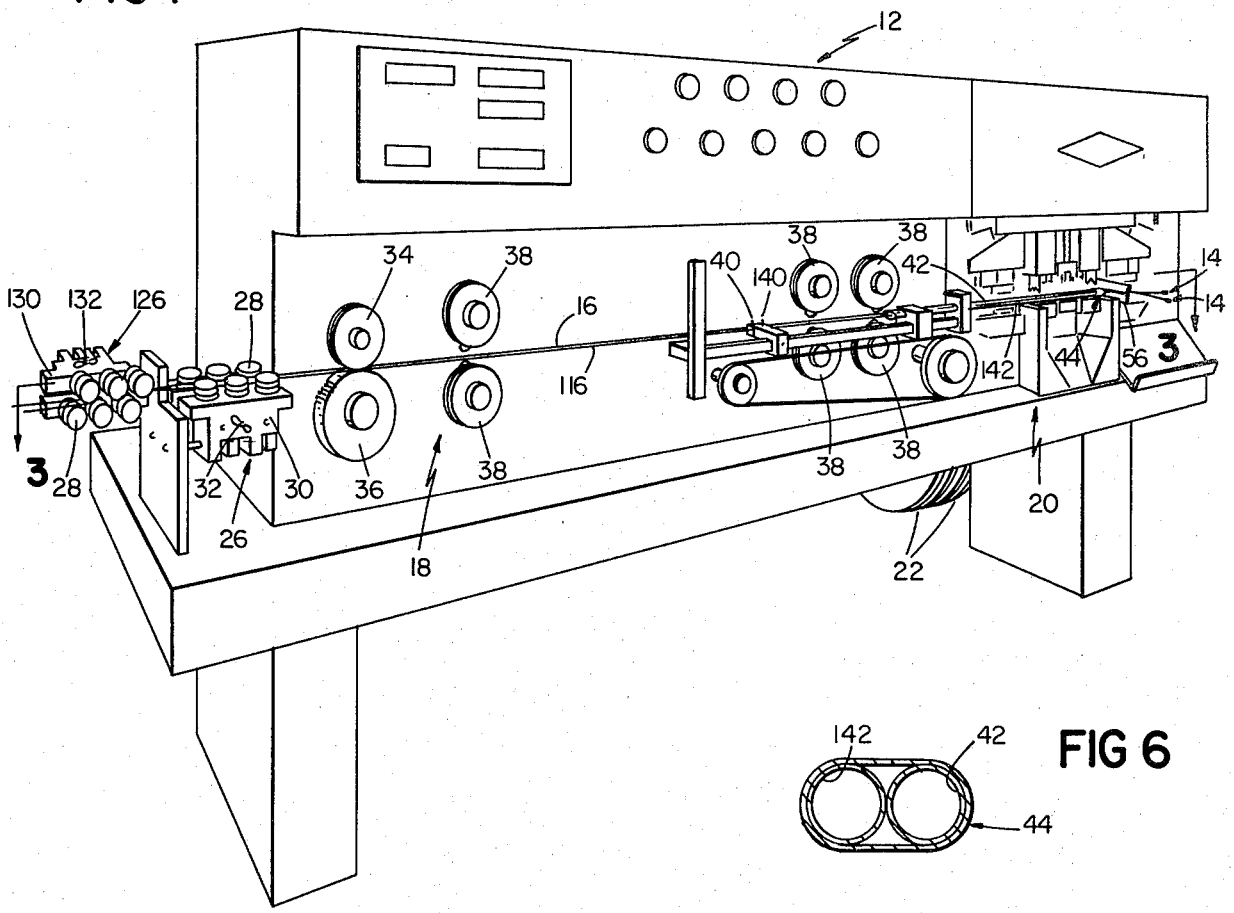
FIG 6
FIG 3
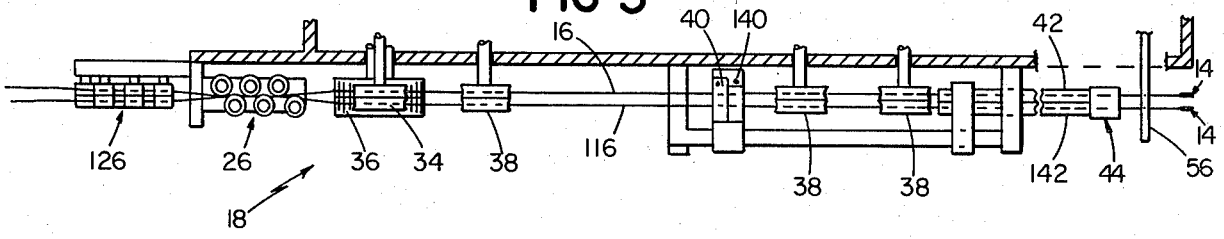
FIG 4
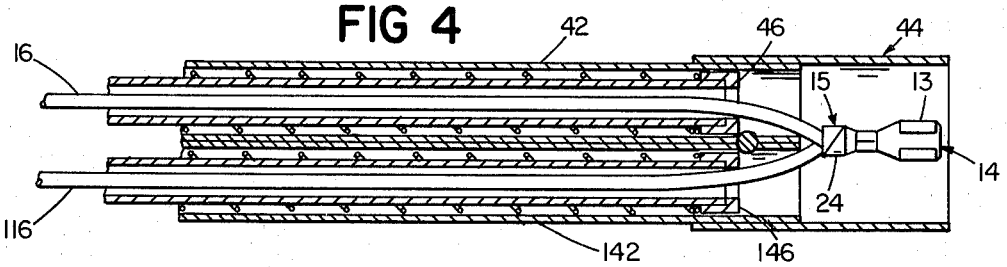
FIG 5
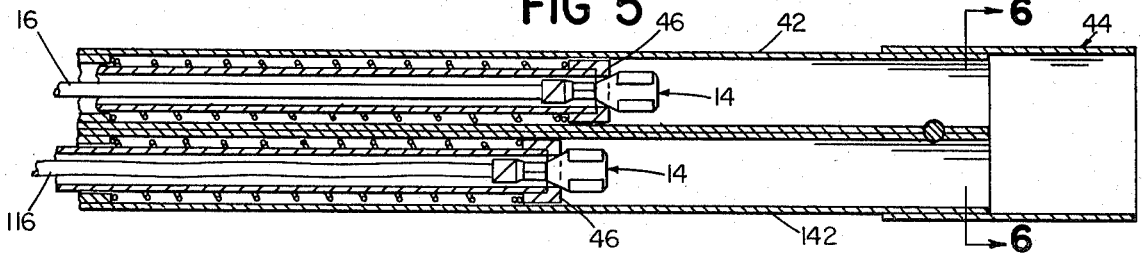

FIG 7
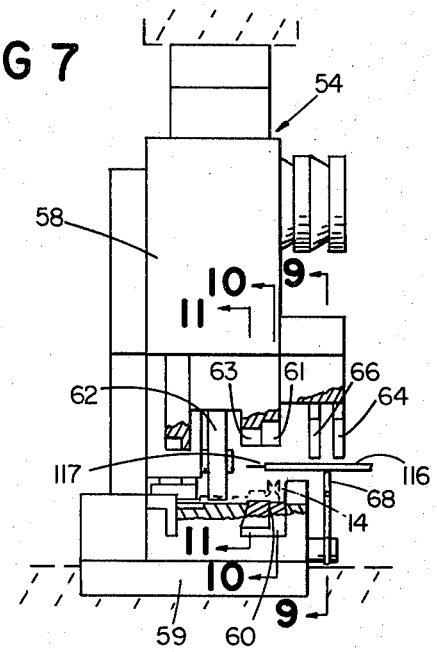
FIG 8
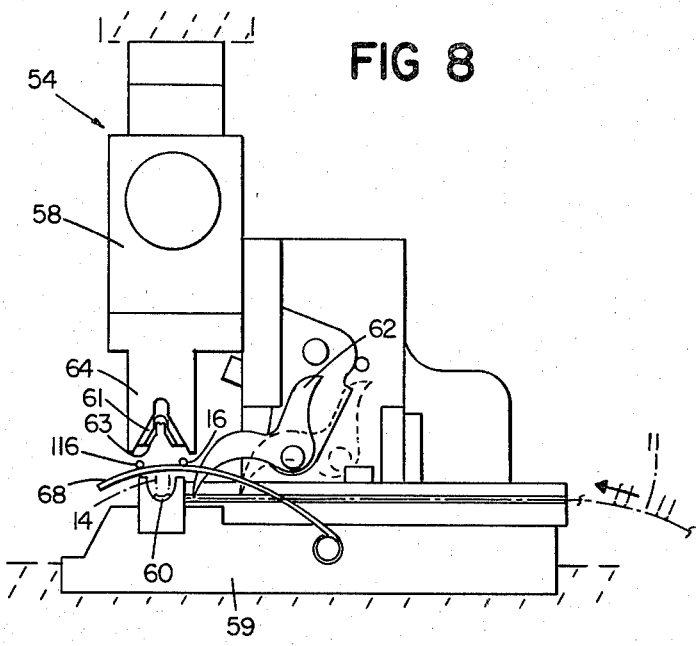
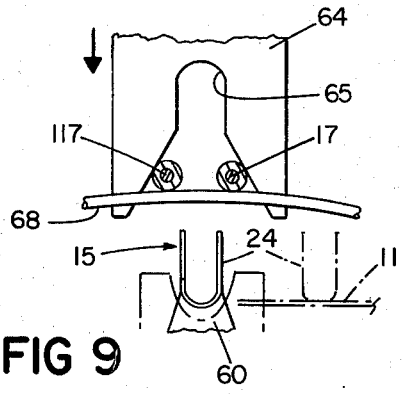
FIG 9
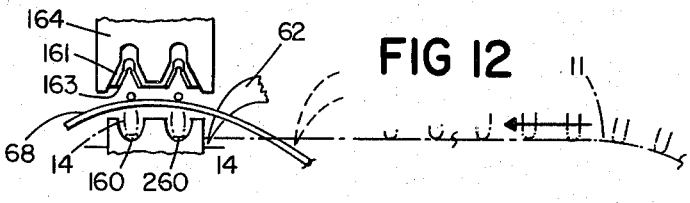
FIG 12
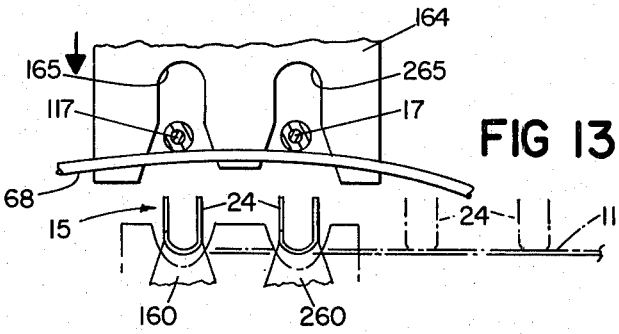
FIG 13
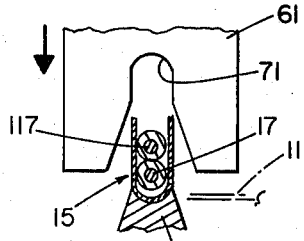
FIG 10
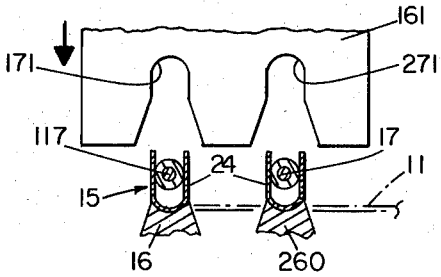
FIG 14
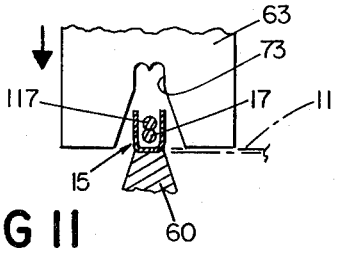
FIG 11
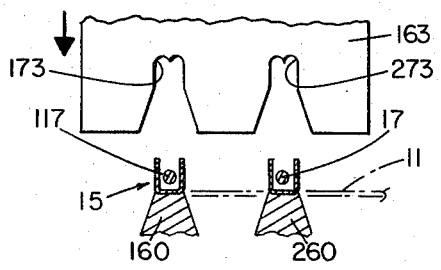
FIG 15

MULTIPLE WIRE TERMINAL APPLYING

This invention relates to apparatus used for attaching terminals to one or both ends of lengths of wire.

The apparatus of the invention is a modification of a portion of an automatic terminal applying machine similar to that disclosed in Gudmestad, U.S. Pat. No. 3,672,025, issued June 27, 1972, which is incorporated by reference herein. The machine disclosed in that patent provides means for simultaneously attaching in-line open barrel terminals to the opposite ends of a single measured length of wire.

However, it is frequently necessary to apply a single terminal to the adjacent ends of multiple wires, for example, to connect two wires together at one of their ends and provide individual terminals at their opposite ends, and this cannot be accomplished with the apparatus of U.S. Pat. No. 3,672,025.

It would also be desirable to increase the production rate of that apparatus by simultaneously attaching terminals to the opposite ends of more than one length of wire at the same time, but, again, this cannot be accomplished with the apparatus of the patent.

Accordingly, it is a major object of the present invention to provide modifications of the apparatus of that patent to provide a novel automatic multiple wire terminal applying machine which is selectively operable to simultaneously attach to one or both of the adjacent or opposite ends of multiple lengths of wire either a single terminal common to all of the wires or an individual terminal on each wire.

The above and still further objects of the invention are provided by a novel automatic multiple wire terminal applying machine for simultaneously attaching at least one terminal, of a terminal carrier strip of terminals attached sidewise to one another to form the terminal carrier strip and fed in its longitudinal direction in a terminal strip plane along a terminal strip feed path, to the adjacent ends of parallellized multiple lengths of wire arranged in a plane parallel to and spaced from the terminal strip plane and fed in their longitudinal direction along a wire feed path perpendicular to the terminal strip feed path.

The machine includes terminal applicator means having a terminal applicator station with one or more terminal applicator positions at the end of the terminal strip feed path, terminal strip carrier feed means for feeding the terminal carrier strip in its longitudinal direction in a terminal strip plane along the terminal strip feed path to the terminal applicator station to place at least one terminal in terminal attaching position, multiple wire feed means for simultaneously feeding the multiple lengths of wire in their longitudinal direction in a wire feeding plane parallel to and spaced from the terminal strip plane along the wire feed path to a position adjacent the terminal applicator station, and multiple wire guide means for guiding the ends of the multiple wires toward the terminal applicator station to place the wire ends in terminal attaching position.

The guide means may be transversly movable toward the terminal strip plane in a direction perpendicular to the wire feed and terminal strip planes and may include slot means for guiding the wire ends, either in the form of a single slot wire guide for guiding all of the wire ends to a single terminal for attaching a single terminal to all of the multiple wires, or in the form of a wire guide having a plurality of slots for guiding each of the wire ends to an individual terminal for attaching a single terminal to each of the multiple wires.

The multiple wire feeding means may comprise multiple parallel wire feed tube means for feeding simultaneously the multiple parallel lengths of wire.

For the purpose of more fully explaining the above and still further objects and features of the present invention, reference is now made to the following detailed description of preferred embodiments thereof, taken together with the accompanying drawings, wherein:

FIG. 1 is a perspective view of the automatic multiple wire terminal applying machine incorporating the present invention;

FIG. 3 is a partial cross-sectional top view of the terminal applying machine of FIGS. 1 and 2, taken along line 3—3 of FIG. 1 and partially broken away;

FIGS. 4 and 5 are enlarged cross-sectional plan views of the multiple wire feed tube portion of the machine of FIGS. 1 through 3, showing it in use for both single and multiple terminal application;

FIG. 6 is an end view of the feed tube portion of FIGS. 4 and 5, with the terminals omitted for clarity;

FIGS. 7 and 8 are enlarged front and side views of the terminal applicator portion of the machine of FIGS. 1 through 3;

FIG. 9 is an enlarged view of a first modification of the wire guide of FIGS. 7 and 8;

FIGS. 10 and 11 are enlarged views of crimping elements used with the wire guide of FIG. 9;

FIG. 12 is an enlarged partial side view of a second modification of the terminal applicator of the machine of FIGS. 1 through 3;

FIG. 13 is an enlarged view of the wire guide of FIG. 12; and

FIGS. 14 and 15 are enlarged views of crimping elements used with the wire guide of FIG. 12.

Figure 2:
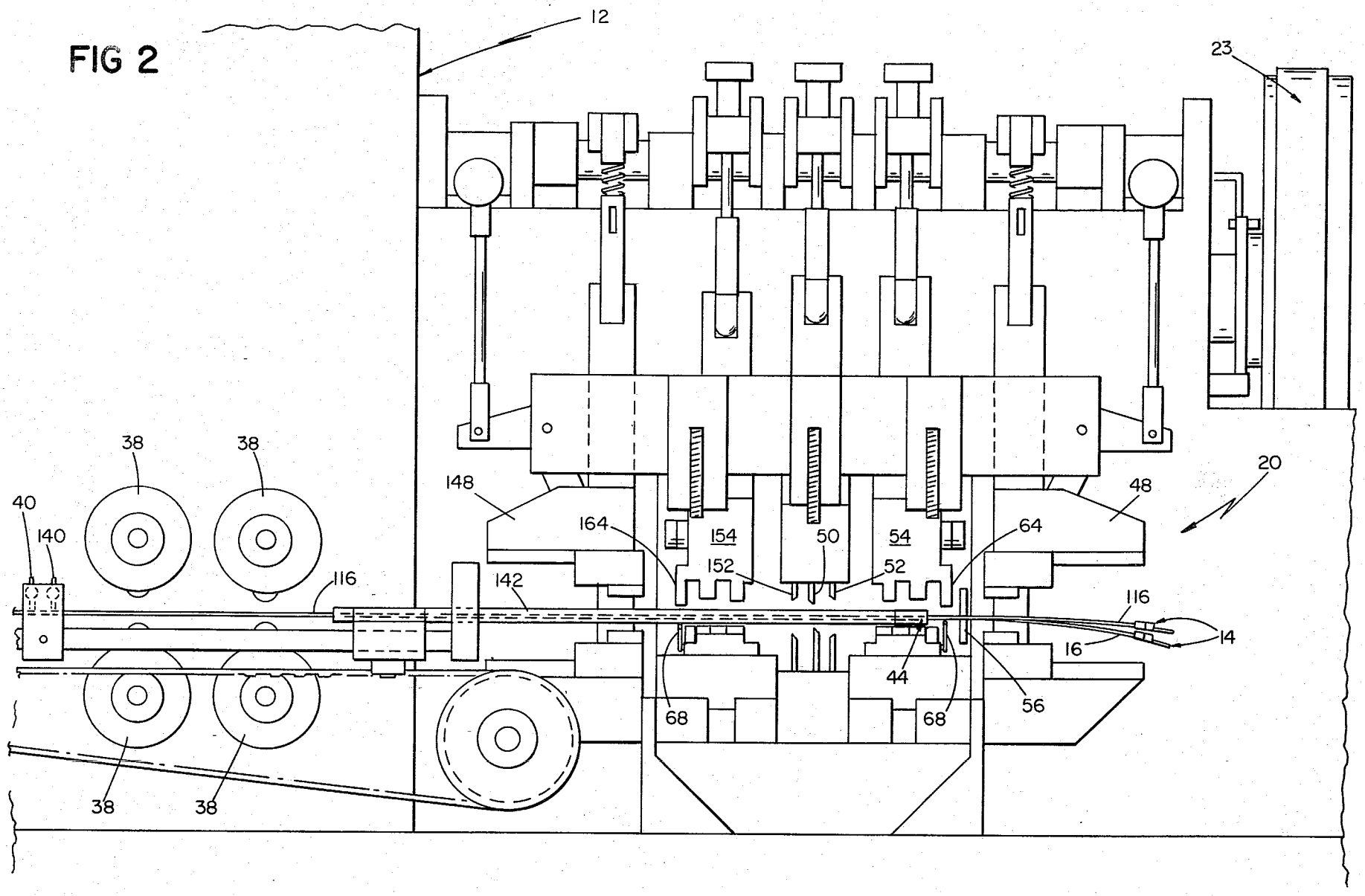
FIG. 2 is an enlarged detailed front view of the terminal applying machine of FIG. 1, partially broken away.

The apparatus of the invention is a modification of an automatic terminal applying machine similar to that disclosed in U.S. Pat. No. 3,672,025.The machine disclosed in that patent provides means for simultaneously attaching to opposite ends of a measured length of wire, in-line open barrel terminals, that is, terminals having an open sided wire-receiving portion, so that the wire end can be inserted in the wire receiving portion of the terminal by relative movement in a transverse direction.

The present invention provides modifications of the apparatus of that patent to provide a novel automatic multiple wire terminal applying machine which is selectively operable to simultaneously attach to one or both of the adjacent or opposite ends of multiple lengths of wire either a single terminal common to all of the wires or an individual terminal on each wire.

Thus, a first modification permits the attachment of a single open barrel terminal to the adjacent ends of a pair of parallel wire ends, while a second modification permits the attachment of such terminals to each of the adjacent ends of lengths of wire. Thus, if desired, the machine can be modified either to apply a single terminal to the adjacent ends of multiple wires, for example, to connect two wires together at one of their ends and provide individual terminals at their opposite ends, or it can be modified to increase the production rate of the machine by simultaneously attaching terminals to the opposite ends of more than one length of wire at the same time.

Referring to the drawings, and more particularly to FIG. 1, an automatic dual wire terminal applying machine, generally designated 12, is shown for attaching in-line open barrel terminals 14 to each end of a pair of parallel measured lengths of wire 16, 116. In general, machine 12 includes spools, not shown, providing a supply of wires 16, 116, a wire metering and feed assembly 18, a terminal attaching assembly 20, a spool 22 providing a supply of a terminal strip 11 of open barrel terminals 14, and a motor and belt assembly 23, as best shown in FIG. 2, for driving machine 12.

Open barrel terminal 14, as best shown in FIGS. 4, 8 and 12, includes a terminal portion 13 and a wire-receiving portion 15 including generally upright tabs 24. Terminal strip 11 consists of a conventional strip of terminals 14 attached sidewise to one another.

More particularly, as best shown in FIGS. 1, 2 and 3, wire metering and feed assembly 18 includes dual wire straightening means, dual wire metering means, dual wire driving means, dual wire feed locking means, and dual wire feed tube means. The dual wire straightening means, which comprises two sets, 126, 26, of double-grooved wire straightening rollers 28, is provided for straightening parallel lengths of wire 16, 116. Each of the sets 126, 26, is positioned perpendicular to the other set. Rollers 28 in each set are rotatably mounted on a jaw-like device, 130, 30, respectively, which is arranged to disengage rollers 28 from wires 16, 116, upon actuation of a screw 132, 32.

The dual wire metering means comprises a double-grooved wire metering roller 34 for measuring wires 16, 116, and a double-grooved wire metering tension roller 36 for maintaining constant tension on the wires. The dual wire driving means, which comprises double-grooved wire drive rollers 38, is provided for feeding the measured parallellized lengths of wire 16, 116, which are arranged in a horizontal plane and fed in their longitudinal direction along a wire feed path, toward the terminal attaching assembly 20. The dual wire feed locking means, which comprises wire engagement brake bars 40, 140, is used for locking wires 16, 116, respectively, at their measured lengths.

The dual wire feed tube means, as best shown in FIGS. 4, 5 and 6, comprises two parallel wire feed outer tubes 42, 142 for simultaneously feeding measured wires 16, 116, respectively, toward terminal attaching assembly 20. Outer tubes 42, 142 are connected at their forward ends to form a recessed cavity portion 44. Each of the outer tubes 42, 142, has an independently spring-biased parallel inner tube 46, 146, respectively, which is adapted to receive one of the wires.

As best shown in greater detail in FIG. 2, terminal attaching assembly 20 includes dual wire clamps 148, 48 for clamping the wires, dual wire cutter 50 for cutting the wires, dual wire strippers 152, 52 for stripping parallel wire ends 17, 117, dual terminal applicators 154, 54 operable to apply terminals 14 to the stripped wire ends 17, 117, and wire ejector 56 for discharging wires 16, 116 having terminals 14 attached thereto.

As best shown in FIGS. 7 and 8, terminal applicator 54 includes a housing 58 having a base 59 providing a terminal applicator station with one or more terminal applicator positions at the end of the terminal strip feed path. Terminal strip feed means, including a conventional terminal strip feeding finger 62, is provided for feeding terminal strip 11 in its longitudinal direction in a terminal strip plane parallel to the wire feed plane along a terminal strip feed path perpendicular to and spaced below the wire feed path for positioning one or more terminals 14 at one or more terminal applicator positions adjacent each one of the parallel stripped wire ends 17, 117.

One or more reciprocal crimping elements, as hereinafter more fully described, are also provided for crimping terminals 14 onto wire ends 17, 117 in the usual manner.

In accordance with the present invention, multiple wire guide means in the form of reciprocal slotted guide plates cooperating with an underlying leaf spring 68 are provided for transversly moving and guiding the stripped wire ends 17, 117 in a direction generally perpendicular to the wire feed and terminal strip planes along a desired path toward a terminal applicator position to place them into wire-receiving portion 15 of one or more terminals 14 for crimping.

The first modification of the present invention, as best shown in FIGS. 7, 8, 9, 10 and 11, provides for attachment of a single terminal 14 to both adjacent wire ends 17, 117. In this modification, terminal-feeding finger 62 is operated to feed a single terminal 14 at the end of the terminal strip 11 onto terminal applicator position 60; the wire guide means includes an outer wire guide plate 64 with a single inverted "V" bottom slot 65 and an identical inner wire guide plate 66; and the insulation and bare wire crimping elements 61, 63 each include a single crimping recess, 71, 73, respectively, for receiving both of the wire ends 17, 117.

In the operation of this modification, a single terminal 14 at the end of terminal strip 11 is fed along the terminal strip feed path onto terminal applicator position 60 and wires 16, 116 are fed by feed tubes 42, 142 along the wire feed path to cutter 50 and strippers 152, 52. Feed tubes 42, 142 are then retracted.

After cutting and stripping, wires 116, 16 are retracted until their ends 17, 117 are adjacent to terminal applicator position 60, leaving wire ends 17, 117 supported by underlying spring 68.

Wire guide plates 64, 66 are then moved downwardly to guide wire ends 17, 117, while they remain supported by spring 68, into the upper portion of guide plate slot 65, as shown in FIG. 9. The wire ends 17, 117 are then crimped together by the single crimping recesses 71, 73 of insulation and bare wire crimping elements 61, 63 in the usual manner.

After crimping, feed tubes 42, 142 are then advanced to receive terminal 14 within its recessed cavity portion 44, so that terminal 14 will be protected from adjacent machine parts as feed tubes 42, 142 are further advanced to begin the next machine cycle.

The second modification of the present invention, as best shown in FIGS. 12, 13, 14 and 15, provides for attachment of an individual terminal 14 to each of the adjacent wire ends 17, 117. In this modification, terminal-feeding finger 62 is operated to feed two terminals 14 at the end of the terminal strip 11 onto two terminal applicator positions 160, 260 spaced side by side at the end of the terminal strip feed path; the wire guide means includes a reciprocal outer wire guide plate 164 with two inverted "V" bottom slots 165, 265 and an identical inner wire guide plate; and the insulation and bare wire crimping elements 161, 163 each include two crimping recesses, 171, 271 and 173, 273, respectively, for separately receiving wire ends 17, 117.

In the operation of this modification, two terminals 14 at the end of terminal strip 11 are fed along the terminal strip feed path onto terminal applicator positions 160, 260 and wires 16, 116 are fed by feed tubes 42, 142 along the wire feed path to cutter 50 and strippers 152, 52. Feed tubes 42, 142 are then retracted.

After cutting and stripping, wires 116, 16 are retracted until their ends 17, 117 are adjacent to terminal applicator positions 160, 260, leaving wire ends 17, 117 supported by underlying spring 68.

Outer wire guide plate 164, together with its identical inner wire guide plate, is then moved downwardly to separately guide wire ends 17, 117, while they remain supported by spring 68, into the upper portions of guide plate slots 165, 265, as shown in FIG. 13. The separated wire ends 17, 117 are then individually crimped on individual terminals 14 by the double crimping recesses 171, 271 and 173, 273, respectively, of insulation and bare wire crimping elements 161, 163 in the usual manner.

After crimping, feed tubes 42, 142 are then advanced to receive both terminals 14 within outer feed tubes 42, 142, so that terminals 14 will be protected from adjacent machine parts as feed tubes 42, 142 are further advanced to begin the next machine cycle.

Still further modifications of the invention, within the spirit thereof and the scope of the appended claims, such as modifications for simultaneously attaching terminals to more than two wires, will occur to those skilled in the art.

What is claimed is:

1. An automatic multiple wire terminal applying machine for simultaneously attaching at least one terminal, of a terminal strip of terminals attached sidewise to one another to form said terminal strip and fed in its longitudinal direction in a terminal strip plane along a terminal strip feed path, to the adjacent ends of parallellized multiple lengths of wire arranged in a plane parallel to and spaced from said terminal strip plane and fed in their longitudinal direction along a wire feed path perpendicular to said terminal strip feed path said machine including terminal applicator means having a terminal applicator station with a terminal applicator position at the end of said terminal strip feed path terminal strip carrier feed means for feeding said terminal carrier strip in its longitudinal direction in a terminal strip plane along said terminal strip feed path to said terminal applicator station to place at least one terminal in terminal attaching position multiple wire feed means for simultaneously feeding said multiple lengths of wire in their longitudinal direction in a wire feed plane parallel to and spaced from said terminal strip plane along said wire feed path to a position adjacent said terminal applicator station, and multiple wire guide means for guiding the ends of said multiple wires toward said terminal applicator station to place said wire ends in terminal attaching position, said multiple wire feeding means comprising multiple parallel wire feed tube means for feeding simultaneously said multiple parallel lengths of wire, and said feed tube means comprising a plurality of parallel outer tubes connected together to provide a recessed cavity at their forward ends for receiving attached terminals therewithin when feeding said attached terminals through said machine.

2. An automatic multiple wire terminal applying machine as claimed in claim 1, wherein said guide means includes means for guiding all of said wire ends to a single terminal for attaching a single terminal to all of said multiple wires.

3. An automatic multiple wire terminal applying machine as claimed in claim 1, wherein said guide means includes means for guiding each of said wire ends to an individual terminal for attaching a single terminal to each of said multiple wires.

4. An automatic multiple wire terminal applying machine for simultaneously attaching a plurality of terminals, of a terminal strip of terminals attached sidewise to one another to form said terminal strip and fed in its longitudinal direction in a terminal strip plane along a terminal strip feed path, to the adjacent ends of parallellized multiple lengths of wire arranged in a plane parallel to and spaced from said terminal strip plane and fed in their longitudinal direction along a wire feed path perpendicular to said terminal strip feed path said machine including multiple terminal applicator means having a multiple terminal applicator station with a plurality of terminal applicator positions at the end of said terminal strip feed path terminal strip carrier feed means for feeding said terminal carrier strip in its longitudinal direction in a terminal strip plane along said terminal strip feed path to said terminal applicator station to place multiple terminals in terminal attaching position multiple wire feed means for simultaneously feeding said multiple lengths of wire in their longitudinal direction in a wire feed plane parallel to and spaced from said terminal strip plane along said wire feed path to a position adjacent said terminal applicator station, and multiple wire guide means for guiding the ends of said multiple wires toward said terminal applicator station to place said wire ends in terminal attaching position, said multiple wire feeding means comprising multiple parallel wire feed tube means for feeding simultaneously said multiple parallel lengths of wire, and said feed tube means comprising a plurality of parallel outer tubes connected together to provide a recessed cavity at their forward ends for receiving attached terminals therewithin when feeding said attached terminals through said machine.

5. An automatic multiple wire terminal applying machine as claimed in claim 1 or 4, wherein said guide means is transversely movable in a direction perpendicular to said wire feed and terminal strip planes.

6. An automatic multiple wire terminal applying machine as claimed in claim 1 or 4 wherein said guide means includes slot means for guiding said wire ends.

7. An automatic multiple wire terminal applying machine as claimed in claim 6, wherein said slot means includes a single slot for guiding all of said wire ends to a single terminal for attaching a single terminal to all of said multiple wires.

8. An automatic multiple wire terminal applying machine as claimed in claim 6, wherein said slot means includes a plurality of slots for guiding each of said wire ends to an individual terminal for attaching a single terminal to each of said multiple wires.

* * * * *